US005856001A

United States Patent [19]

Okumura et al.

[11] Patent Number: 5,856,001

[45] Date of Patent: Jan. 5, 1999

[54] INK JET RECORDING MEDIUM

[75] Inventors: Yoshitaka Okumura, Chiba; Akira Maeda, Yonago; Yoshiharu Kawashima, Soka; Satoshi Matsuura, Tokyo, all of Japan

[73] Assignee: OJI Paper Co. Ltd., Tokyo, Japan

[21] Appl. No.: 923,979

[22] Filed: Sep. 5, 1997

[30] Foreign Application Priority Data

Sep. 10, 1996 [JP] Japan ..... 8-238939
Sep. 11, 1996 [JP] Japan ..... 8-240086

[51] Int. Cl.[6] ..... B41M 5/00

[52] U.S. Cl. ..... 428/331; 428/195; 428/328; 428/329; 428/330; 428/409

[58] Field of Search ..... 428/195, 328–331, 428/409

[56] References Cited

U.S. PATENT DOCUMENTS 4,460,637 7/1984 Miyamoto et al. .

FOREIGN PATENT DOCUMENTS 524 626 A1 1/1993 European Pat. Off. .
701 904 A1 3/1996 European Pat. Off. .
705 710 A1 4/1996 European Pat. Off. .
709 223 A1 5/1996 European Pat. Off. .
52-53012 4/1977 Japan .
53-49113 5/1978 Japan .
55-51583 4/1980 Japan .
56-148585 11/1981 Japan .
57-107878 7/1982 Japan .
58-110287 6/1983 Japan .
59-185690 10/1984 Japan .
61-141584 6/1986 Japan .
4-16379 1/1992 Japan .

OTHER PUBLICATIONS

"Testing Methods for Peel Strength of Adhesives," JIS K 6854, 1994, Japanese Industrial Standard.
"Pencil Scratch Tester for Coated Film, "JIS K 5401, 1969; Japanese Industrial Standard.

*Primary Examiner*—Pamela R. Schwartz
*Attorney, Agent, or Firm*—Nikaido, Marmelstein, Murray & Oram LLP

[57] ABSTRACT

An ink jet recording medium having excellent image reproducibility, ink-drying property and pencil writing property has an ink receiving layer, formed on a substrate, including porous xerogel pigment particles, wherein the surface of the ink receiving layer has a pencil scratch value of 50 g or more determined by a pencil scratch tester for coated film in accordance with Japanese Industrial Standard K 5401-1969.

10 Claims, 1 Drawing Sheet

INK JET RECORDING MEDIUM

BACKGROUND OF THE INVENTION (1) Field of the Invention

The present invention relates to an ink jet recording medium on which visible images are recorded with an aqueous ink. More particularly, the present invention relates to an ink jet recording medium having excellent ink absorption and image reproducibility and a satisfactory surface strength for office recording sheets and capable of being hand-written thereon by a pencil and allowing pencil marks thereon to be erased with a rubber eraser.

(2) Description of the Related Art

An ink jet recording system using an aqueous ink is advantageous in that noise during the recording procedure is low, colored images can be easily recorded, and the recording procedure can be carried out at a high speed. Thus the application of the ink jet recording system to terminal printer, facsimile machine, plotter and printer for accounting books and slips is progressing. Since usual wood free paper sheets and coated paper sheets usable for conventional printing have an unsatisfactory ink absorption, when these paper sheets are subjected to the ink jet printing, the applied inks are retained in a non-dried condition on the sheet surface for a long time, and thus stain the printing apparatus, the printed sheets and printed images. Therefore, conventional paper sheets are not suitable for the ink jet recording practice.

To solve the above-mentioned problems, Japanese Unexamined Patent Publication No. 52-53012 proposes to use recording paper sheets having a low sizing degree, and Japanese Unexamined Patent Publication No. 53-49113 provides urea-formaldehyde resin-containing paper sheets impregnated with a water-soluble polymeric material.

Also, various types of recording paper sheets having a surface thereof coated with various porous inorganic pigments including amorphous silica which are used for the purpose of enhancing an ink-coloring property and colored-image reproducibility are provided by Japanese Unexamined Patent Publication No. 55-51,583 and No. 56-148,585.

Further, Japanese Unexamined Patent Publication No. 58-110,287, No. 59-185,690, and No. 61-141,584 disclose an improvement in the physical properties of the above-mentioned porous pigments for the purpose of preventing a spread of ink and of forming ink images with high accuracy.

The above-mentioned recording media have a high ink absorption and are capable of recording ink images having a high clarity at a high reproducibility. However, these recording media are still unsatisfactory in surface strength, pencil-writing properties, and erasing properties, of pencil marks, with a rubber eraser, and thus are not suitable as office recording sheets.

To enhance the applicability of the conventional paper sheets to office recording work, for example, pencil writing, employment of a writing-property enhancing agent was proposed by, for example, Japanese Unexamined Patent Publication No. 57-107,878. However, the writing-property enhancing agent does not contribute to enhancing the absorption of water-soluble ink used for printing, and thus when the writing property-enhancing agent is contained in the ink-receiving layer, a problem that the form of printed dots becomes irregular and thus the reproducibility of ink images is decreased, occurs.

Also, Japanese Unexamined Patent Publication No. 4-16,378 proposes to appropriately employ two or more types of porous pigments different in fine pore radius from each other for the purpose of enhancing both the image-reproducibility and the pencil-writing properties. This proposal exhibits a considerable enhancement in both the properties. However, when the amount of coating is increased, to obtain high accuracy images, the pencil writing property is degraded. Therefore the proposal is not satisfactory.

As mentioned above, although an employment of the pigments having a large particle size is proposed for the purpose of enhancing the pencil writing property, since the pigment is not always selected under consideration of ink-receiving property thereof, the reproducibility of high accuracy images is unsatisfactory.

SUMMARY OF THE INVENTION

An object of the present invention is to provide an ink jet recording medium capable of recording thereon high accuracy, high resolution images with a high reproducibility, and having a surface strength sufficient for office recording and satisfactory pencil writing and pencil mark-erasing with a rubber eraser properties.

The above-mentioned object can be attained by the ink jet recording medium of the present invention which comprises a substrate and an ink receiving layer formed on the substrate and comprising porous xerogel pigment particles, wherein the surface of the ink receiving layer has a pencil scratch value of 50 g or more determined by a pencil scratch tester for coated film in accordance with Japanese Industrial Standard K 5401-1969.

In the ink jet recording medium of the present invention, the pencil scratch value is preferably 70 g or more.

In the ink jet recording medium of the present invention, the porous xerogel pigment particles contained in the ink receiving layer preferably have a specific surface area of 25 to 400 $m^2/g$ determined by the BET method.

In the ink jet recording medium of the present invention, the ink receiving layer preferably comprises first porous xerogel pigment particles having a BET specific surface area of 25 to 400 $m^2/g$ and second porous xerogel pigment particles having a BET specific surface area in the range from 250 to 1500 $m^2/g$ and larger than the above-mentioned BET specific surface area of the first porous xerogel pigment particles.

The specific surface area of the pigment particles of the BET method was measured by using nitrogen gas as the measurement gas.

The average particle size of the pigment particles was measured by a natural precipitation method (light-scattering method).

DESCRIPTION OF THE PREFERRED EMBODIMENTS

Figure 1:
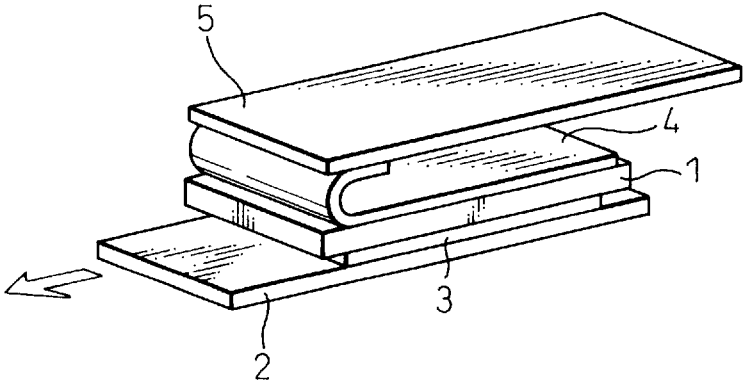
FIG. 1 shows a test method of measuring a peel strength of an ink jet recording medium of the present invention at a peeling angle of 180 degree, in accordance with Japanese Industrial Standard K-6854-1994.

The inventors of the present invention researched in detail the properties necessary for the materials for an ink jet recording medium, particularly the properties of the materials for forming the ink receiving layer and the properties of the ink receiving layer and as a result, succeeded in providing an ink jet recording medium having not only an excellent image reproducibility but also a superior aptitude as an office recording sheet.

In the ink jet recording medium of the present invention, the porous xerogel pigments to be contained in the ink receiving layer can be produced by utilizing various methods, for example, (1) a method in which a hydrogel-forming material, for example, aluminum hydroxide, alumina, silica such as amorphous silica, and magnesium oxide, is used as a starting material, the hydrogel is dried to provide a xerogel, and the xerogel is finely divided and classified, (2) a method in which primary particles of the above-mentioned oxides are agglomerated into secondary particles and optionally into tertiary particles having an appropriate particle size, the agglomerate particles are dried and then heat treated to sinter and crystallize the particles so as to enhance the bonding strength between the primary particles of the oxides, and (3) a method in which fine particles of colloidal silica or colloidal alumina are suspended in an liquid medium, the suspension is added with an urea-formaldehyde resin or a melamine-formaldehyde resin to form agglomerate particles, while controlling the conditions for forming the agglomerate particles to provide target agglomerate secondary fine particles, drying the resultant particles and optionally sintering the dried particles. The porous xerogel pigments are commercially available.

The porous xerogel pigments are in the state of a dried gel and exhibit an excellent ink-absorbing property.

Among the porous xerogel pigments, the silica pigments are advantageously used for the ink jet recording medium having excellent ink-receiving property and capable of recording ink images having high color density, due to a relatively low refractive index and easy controllability of the porous structure thereof.

To impart satisfactory pencil writing property and pencil mark-erasing with an rubber eraser property to the ink jet recording medium, the surface of the ink receiving layer must exhibit a pencil scratch value of 50 g or more determined by a pencil scratch tester for coated film in accordance with Japanese Industrial Standard K 5401-1969.

If the pencil scratch value is less than 50 g, the resultant ink receiving layer exhibits an unsatisfactory pencil writing property with the 2B, B, HB, F, or H pencils which are commonly used for office work. Also, in this case, the pencil writing can be made on the resultant ink receiving layer when a specifically soft pencil of 4B or more is used. However, the resultant pencil marks cannot be fully erased, or cause the surroundings of the pencil marks to be soiled black and thus are not practically usable.

To impart satisfactory pencil writing properties at any pencil hardness and a sufficient pencil mark-erasing property to the ink receiving layer of the ink jet recording medium, the pencil scratch value determined by the pencil scratch tester for coated film in accordance with Japanese Industrial Standard K 5401, must be controlled to 50 g or more, preferably 70 g or more. There is no specific limitation to the upper limit of the pencil scratch value. Practically, the pencil scratch value can rise up to about 350 g. Usually, the pencil scratch value is more preferably 75 to 280 g.

Also, the porous xerogel pigment particles preferably have a BET specific surface area of 25 to 400 $m^2/g$, more preferably 100 to 400 $m^2/g$. By controlling the BET specific surface area in the above-mentioned range, the ink-absorbing property and the color density of the recorded images of the ink-receiving layer can be enhanced. The pigment particles preferably have an agglomerate particle structure in which a plurality of primary particles are agglomerated to form a secondary particle. When the BET specific surface area is relatively small as mentioned above, the primary particles from which the agglomerate particles are formed usually have a relatively large average particle size, and exhibit a low agglomerate power and thus the resultant agglomerate particles have a large inner volume, and can contribute to enhancing the ink-absorbing property and color density of recorded images.

If the BET specific surface area is too small, the resultant ink receiving layer may exhibit a reduced surface strength. For example, by appropriately choosing the binder, etc, the image-forming aptitude and the pencil scratch strength can be appropriately balanced. If the BET specific surface area is less than 25 $m^2/g$, the resultant ink receiving layer may exhibit an unsatisfactory surface strength. Also, if the BET specific surface area is too large, the resultant ink receiving layer may exhibit an unsatisfactory ink-absorbing property and an insufficient color density of recorded images.

To ensure a pencil scratch value in the above-mentioned level, it is necessary to appropriately balance the image-forming aptitude and the pencil scratch value by appropriately choosing the type of the binder and the content of the binder.

The coating amount of the ink receiving layer is appropriately established in consideration of purpose and use. Usually, the ink receiving layer is formed in an amount of 0.5 to 50 $g/m^2$. When the amount of the ink jetted from the ink jet printer is large, or when a more accurate higher resolution than usual recording property is required, it is preferred to increase the coating amount of the ink receiving layer. However, the increase in the coating amount may cause the pencil scratch value to be decreased. When the coating amount of the ink receiving layer is too small, for example, 5 $g/m^2$ or less, the pencil scratch value may be excellent.

Also, the pencil scratch value is enhanced by applying a super calender treatment to the surface of the ink jet recording medium.

Further, the pencil scratch value can be further increased by co-using second porous xerogel pigment particles having a relatively large BET specific surface area together with the first pigment particles having the above-mentioned BET specific surface area. The primary particles, from which agglomerate particles having a large BET specific surface area are formed, are generally fine and can firmly agglomerate with each other to form secondary particles. When the firmly agglomerated pigment particles are co-used, the mechanical strength of the coating layer is enhanced, and the pencil writing property, which is an important feature of recording sheet for office work, can be enhanced. Therefore, the co-use of the second pigment particles is a preferred embodiment of the present invention.

As mentioned above, various attempts were made to improve the pencil writing property by using various pigment particles having a large particle size. However, in these attempts, the pigments were not always selected in consideration of the ink-receiving property thereof. Therefore, the target ink jet recording medium having a satisfactory reproducibility of high accuracy, high resolution images could not be obtained. In the above-mentioned embodiment of the present invention, however, the ink jet recording medium having an excellent reproducibility of the high accuracy images and a satisfactory aptitude for office recording sheet can be obtained by specifically selecting and using at least two types of porous xerogel pigment particles different in BET specific surface area from each other, namely first porous xerogel pigment particles having a relatively small BET specific surface area of 25 to 400 $m^2/g$ and second porous xerogel pigment particles having a relatively large BET specific surface area of 250 to 1500 $m^2/g$ and larger than that of the first porous xerogel pigment particles, to form the ink receiving layer.

The second porous xerogel pigment particles having a BET specific surface area of 250 to 1500 $m^2/g$ and usable for the present invention, per se have a certain amount of an ink-absorbing property and contribute to enhancing the reproducibility of the images, the strength of the ink receiving layer, the pencil writing property (to solve the problem that the ink receiving layer exfoliates and writing with a hard pencil is difficult) and the pencil mark-erasing with a rubber eraser property. However, when the agglomerate particles having a large BET specific surface are used, on one hand, the primary particles are firmly agglomerated and on other hand, when too much of this type of agglomerate particle are used, the resultant ink receiving layer exhibits a reduced ink absorbing property. Therefore, when the resultant ink receiving layer is used in combination with a printer having a large ink-jetting amount, the use of the above-mentioned porous xerogel pigment alone may not allow the purpose of the present invention to be attained.

Namely, when the porous xerogel pigment having a large BET specific surface area is used, the BET specific surface area of the pigment can be selected from 250 to 1500 $m^2/g$, preferably 250 to 500 $m^2/g$. The higher the content of the pigment having the large BET specific surface area, the higher the pencil scratch value and the lower the ink-absorbing property of the resultant ink receiving layer.

When the first and second pigments are co-used, there is no limitation to the mixing ratio between them. Usually, the mixing ratio, by weight, of the second porous xerogel pigment particles having a BET specific surface area of 250 to 1500 $m^2/g$ and larger than that of the first porous xerogel pigment particles to the first porous xerogel pigment particles having a BET specific surface area of 25 to 400 $m^2/g$ is preferably 30:70 to 70:30.

If the ratio is less than 30/70, the contribution of the porous xerogel pigment particles to retaining the pencil scratch value for coated film at a high level is low. Therefore, the pencil scratch value must be retained by another means, and the ink absorption capacity of the resultant ink receiving layer may be insufficient depending on the type of the printer used in combination with the ink receiving layer. If the ratio is more than 70/30, although the coated film pencil scratch value of the resultant ink receiving layer is sufficient, the contribution of the first porous xerogel pigment particles having the small BET specific surface area value to the quality of the resultant ink receiving layer is low and thus sometimes the ink absorption capacity is low depending on the printer used, or the color density of the printed images is reduced.

By adjusting the average particle size of the second porous xerogel pigment particles having the large BET specific surface area to larger than the average particle size of the first porous xerogel pigment particles having the small BET specific surface area, the ink jet recording medium can have further enhanced reproducibility of high accuracy images, pencil writing property and aptitude for office recording sheets.

The average particle size of the second porous xerogel pigment particles having the large BET specific surface area is preferably 3 to 30 $\mu$m, more preferably 4 to 20 $\mu$m, and the average particle size of the first porous xerogel pigment particles having the small BET specific surface area is preferably 1 to 15 $\mu$m, more preferably 1.5 to 8 $\mu$m.

The ink receiving layer optionally contains, in addition to the specific porous xerogel pigment particles, other pigments, for example, inorganic pigments such as calcium carbonate, kaolin, talc, calcium sulfate, barium sulfate, titanium dioxide, zinc oxide, zinc carbonate, satin white, aluminum silicate, diatomaceous earth, calcium silicate, magnesium silicate, white carbon, alumina, and aluminum hydroxide pigments, and organic pigments such as styrene resins, acrylic resins, urea resins, melamine resins, and benzoguanamine resins.

The binder for the ink receiving layer comprises at least one member selected from natural and semi-synthetic polymeric materials, for example, starch and derivatives thereof, carboxymethylcellulose, hydroxyethylcellulose, casein, gelatin, and soybean protein; aqueous solutions and aqueous dispersions of polyvinyl alcohols and derivatives thereof, silyl-modified polyvinyl alcohols, cation-modified polyvinyl alcohols, polyvinyl butyral resins, polyethyleneimine resins, polyvinylpyrrolidone resins, poly(meth)acrylic acid resins, acrylic acid ester resins, polyamide resins, polyacrylamide resins, polyester resins, urea resins, melamine resins, and vinyl copolymer resins for example, styrene-butadiene copolymers, methylmethacrylate-butadiene copolymers, and ethylene-vinyl acetate resins; and modified polymers prepared by introducing anionic or cationic residues into the above-mentioned polymers.

Particularly, the polyvinyl alcohols and derivatives thereof, especially silyl-modified polyvinyl alcohols, and starch compounds advantageously cause the recording property and pencil scratch value to be appropriately balanced.

There is no limitation to the mixing ratio of the pigment to the binder. Usually, the binder is preferably used in an amount of 10 to 200 parts by weight per 100 parts by weight of the pigment. If the amount of the binder is too small, the pencil scratch value of the resultant ink receiving layer may be unsatisfactory.

In the ink jet recording medium of the present invention, the ink receiving layer optionally contains a cationic polymeric compound which contributes to enhancing the water resistance of printed images formed from an aqueous ink. The cationic polymeric compound is preferably selected from polyethyleneimine resins, polyamine resins, polyamide resins, polyamide-epichlorohydrin resins, polyamine-epichlorohydrin resins, polyamidepolyamine-epichlorohydrin resins, polydiallylamine resins and dicyanediamide condensation products.

Optionally, the ink receiving layer further contains conventional additives usable for the ink jet recording materials, for example, pigment-dispersing agents, thickening agents, antifoaming agents, foam-inhibiting agents, foaming agents, releasing agents, introfiers, wetting agents, thermogelatinizing agents and lubricants.

The ink receiving layer can be formed by a conventional coating method using, for example, a size press, gate roll, roll coater, bar coater, air knife coater, rod blade coater or blade coater.

Another specifically preferred embodiment of the present invention in which two specific types of pigments are used will be explained below.

As mentioned above, in prior art, since the pigment particles having large particle size, which were provided as means for improving the pencil writing property of the ink receiving layer, were not always selected in consideration of a contribution thereof to the ink-receiving property of the ink receiving layer, the resultant ink receiving layer was unsatisfactory in reproducibility of high accuracy images. In this embodiment, the first porous xerogel pigment particles have an agglomerate secondary particle structure in which primary particles are agglomerated to form secondary particles and have a BET specific surface area of 25 to 350 $m^2/g$; the second porous xerogel pigment particles have an agglomerate secondary particle structure in which primary particles are agglomerated to form secondary particles, and have a BET specific surface area of more than 350 $m^2/g$ but not more than 1500 $m^2/g$; and a fraction of the second porous xerogel pigment particles consisting of pigment particles having a secondary particle size of 10 $\mu$m or more occupies 8 to 30% by weight of the ink receiving layer.

The specific pigment to be used for the embodiment of the present invention and comprising pigment particles having a BET specific surface area of more than 350 $m^2/g$ but not more than 1500 $m^2/g$ and including a certain content of a fraction consisting of pigment particles having a secondary particle size of 10 $\mu$m or more, per se, has a certain amount of an ink-absorption property and contributes to the reproducibility of the images. Also, the primary particles, from which the secondary particles are formed, are firmly bonded to each other and the resultant secondary particles have appropriate surface roughness. Therefore, the specific pigment contributes to providing an ink jet recording medium having an excellent aptitude, for example, a pencil writing property, for office recording sheets. The particle size and content of the agglomerate particles can be determined, for example, by dispersing the agglomerate particles in water by an appropriate method, and measuring the particle size distribution of the agglomerate particles by using a coulter counter method, or by directly observing the ink receiving layer surface through a microscope.

When the bonds for connecting the primary particles to each other to form the secondary particles are uniformly distributed on the surfaces of the primary particles, since the total number of the bonds is proportional to the total surface area of the particles, the larger the BET specific surface area of the particles, the larger the number of the bonds per unit weight, and thus, as a whole, the easier the formation of physically strong agglomerate particles.

The primary particles having a particle size of 7 nm or less form the agglomerate particles having a high strength. However, in the agglomerate (secondary) particles formed from the primary particles having a particle size of less than 2 nm, the gaps formed between the primary particles are small, and thus the effect that the solvent molecules of the ink are penetrate into the gaps and thus are absorbed in the agglomerate particles is not fully expected. To obtain an ink receiving layer capable of absorbing the ink at a high speed and exhibiting a satisfactory ink jet printing aptitude, the agglomerate particles comprising the primary particles having a particle size of 2 nm or more are preferably employed. Namely, among the agglomerate pigment particles usable for the present invention, those formed from the primary particles having a particle size of from 2 to 7 nm not only have a high strength and contribute to the pencil writing property but also exhibit a certain amount of an ink absorbing property. Therefore, the above-mentioned agglomerate pigment particles are assumed to be useful for attaining both the satisfactory aptitude for the ink jet printing and the enhanced pencil writing performance.

The particle size of the primary particles can be determined by directly observing the surface of the paper surface or the surfaces of the agglomerate particles by, for example, an electron microscope.

The agglomerate (secondary) particles are formed from a plurality of primary particles having a smaller particle size than the agglomerate particles and are bonded to each other. Therefore, it is assumed that since the ink can penetrate into the gaps formed between the primary particles and thus can be absorbed in the agglomerate particles, the printed ink can be quickly dried so that the printed dots adjacent to each other do not spread toward each other. In this embodiment, by using two or more types of agglomerate pigment particles each having a certain BET specific surface area, an ink jet recording medium having an excellent aptitude for office recording sheet can be obtained. The agglomerate (secondary) particles having a BET specific surface area of 25 $m^2/g$ or more but not more than 350 $m^2/g$ can quickly absorb the ink and contribute to the formation of an ink receiving layer having an excellent reproducibility of high accuracy images.

This type of agglomerate particle, however, is disadvantageous in that the bonds between the agglomerate particles are weak and the office aptitude, such as a pencil writing property, is unsatisfactory. Therefore, it is difficult to allow both the aptitude for ink jet printing and the utility as an office recording sheet to be attained. However, by co-using the above-mentioned agglomerate (secondary) particles having a BET specific surface area of more than 350 $m^2$ g but not more than 1500 $m^2/g$, the above-mentioned problem is solved and a satisfactory pencil writing property can be obtained without degrading the reproducibility of the very accurate high resolution images.

The excellent pencil writing property which is a purpose of the embodiment of the present invention can be obtained by controlling the content of a fraction of the agglomerate particles with a BET specific surface area of more than 350 $m^2/g$ but not more than 1500 $m^2/g$, having an agglomerate particle size of 10 $\mu$m or more, to 8 to 30% by weight based on the total weight of the ink receiving layer. If the above-mentioned content is too low, the resultant pencil writing property-enhancing effect may be insufficient. Also, if the content is too high, the form of the printed dots may be uneven and the color density of the images may be unsatisfactory.

In other words, if the content is too small, the roughness of the resultant coating layer surface is too low, and clear pencil marks, which are formed by abrading the core of pencil, cannot be formed on the ink receiving layer, or the pencil core may slip on the ink receiving layer and thus the hand feeling during writing may be bad. Also, if the content is more than 30% by weight, the secondary particles having a large particle size and a poor ink absorbing property are exposed on the surface of the ink receiving layer, and thus the form of the ink jet printed dots may become irregular.

The agglomerate (secondary) particles having a BET specific surface area of more than 350 $m^2/g$ but not more than 1500 $m^2/g$ preferably have a BET specific surface area of more than 350 $m^2/g$ but not more than 1000 $m^2/g$, more preferably 360 to 500 $m^2/g$.

In the agglomerate (secondary) particles having a BET specific surface area of 25 $g/m^2$ or more but not more than 350 $m^2/g$, if the BET specific surface area is too small, the resultant agglomerate particles may exhibit an insufficient ink-absorbing property. Therefore, the BET specific surface area is preferably 50 $m^2/g$ or more but not more than 350 $m^2/g$, more preferably 100 $m^2/g$ to 330 $m^2/g$.

To obtain the satisfactory aptitude for the ink jet recording and to attain the object of this embodiment, the BET specific surface area of the ink receiving layer is preferably controlled to 350 $m^2/g$ or less. The BET specific surface area of the ink receiving layer can be determined by peeling off a portion of the ink receiving layer by means of, for example, a sharp knife edge and subjected the portion to the known BET method.

The inorganic pigments usable for attaining the object of the present invention are not limited to specific types of inorganic pigments. Preferably, the inorganic pigments are selected from those having an agglomerate (secondary) particle structure, for example, agglomerate particles of aluminum silicate, calcium silicate, magnesium silicate, amorphous silica, alumina, aluminum hydroxide, and magnesium hydroxide. Especially, amorphous silica, aluminum hydroxide and magnesium hydroxide pigments are commercially available in various types and grades, and thus those having desired properties can be appropriately chosen and advantageously employed.

Further, in the present invention, among the above-mentioned agglomerate (secondary) particle type pigments, the amorphous silica pigments are particularly preferred. The amorphous silica pigments are synthesized from silicon tetrachloride by a gas phase method or from sodium silicate by a wet method, for example, a gelation method or a precipitation method. Various types of amorphous silica pigments different in primary particle size or agglomerate (secondary) particle size from each other are available and thus the amorphous silica pigments having the physical properties specified in the present invention can be selected and employed.

The coating method is the same as that mentioned above. The binders and the optional pigments and other additives are the same as those mentioned above.

Another preferred embodiment of the present invention will be explained below.

The methods of producing the amorphous silica are classified into wet methods and dry methods. The wet method silica is produced by using, as a starting material, siliceous sand, mainly silicon dioxide, which exists in large amounts around the globe. The physical properties of the amorphous silica can be controlled by the production method. Namely, various types of amorphous silica having a specific property necessary to desired use, for example, absorptive separations, catalyst carriers, and fillers for paints and resins, can be produced. The wet production methods of the amorphous silica include gelatinization methods and precipitation methods.

In the gelation method, the amorphous silica is produced by mixing sodium silicate produced from a high purity siliceous sand with sulfuric acid to provide a silicic acid sol, gradually polymerizing the silicic acid sol so as to form primary particles and then three-dimensionally to agglomerate the primary particles with each other into agglomerate (secondary particles), namely to gelatinize the sol. In the process, the amorphous silica particles having desired BET specific surface area in the range of from 250 to 1500 $m^2/g$ can be produced by controlling the conditions for forming the primary particles. The resultant amorphous silica is finely divided to a micrometer size and employed.

In the precipitation methods, the amorphous silica is produced under the same conditions as in the gelation method, except that the growth of the agglomerate (secondary) particles is stopped by influence of reaction temperature, co-existing ions or surfactant, and the resultant agglomerate particles are allowed to precipitate. The precipitated amorphous silica particles have a particle size of 0.1 $\mu$m or less. This type of amorphous silica particles have a small BET specific surface area. Namely, the precipitated amorphous silica particle having a BET specific surface area of 25 to 400 $m^2/g$ can be used for the present invention.

In the dry methods, the amorphous silica is produced by burning and hydrolysing $SiCl_4$ in gas phase. Therefore, this method is referred to as dry method against the wet method. In this dry method, the silica particles have no pores or inner gaps and exhibit no inner surface area.

The differences in the performance of the resultant amorphous silica pigments between the amorphous silica pigment production methods are as follows.

The amorphous silica pigment particles produced by the gelation method include primary particles having a small particle size and a strong agglomerating power and thus the resultant secondary particles have a relatively dense structure. However, due to the high density of the structure, the secondary particles have a small pore volume and exhibit a low ink receiving property. Therefore, the amorphous silica pigment produced by the gelation method may exhibit a lower aptitude for ink jet printing than that made by a precipitation method.

In the amorphous silica pigment produced by the precipitation method, the primary particles have a large particle size, and a low agglomeration power, and thus the resultant secondary particles may have a relatively loose structure. The fine pores are gaps formed between the primary particles agglomerated with each other and thus the pore volume is a controllable parameter of the agglomerate particles.

The amorphous silica primary particles made by the gelatinization method form agglomerate (secondary) particles having a higher strength than those produced by the precipitation method. The strong agglomerate particles are expected to contribute to enhancing the strength of the coating layer and causes the pencil writing property which is important for the office recording sheets to be enhanced. As mentioned above, there have been various attempts to improve a pencil writing property by using pigments having a large particle size. However, the pigments are not always selected in consideration of the ink receiving property, and thus no ink jet recording medium having a satisfactory reproducibility of high accuracy images has been obtained. In this embodiment, an ink jet recording medium having an excellent reproducibility of high accuracy, high resolution images and an excellent aptitude for office recording sheet is provided by co-using first amorphous silica pigment particles having a BET specific surface area of 25 to 400 $m^2/g$, more preferably 100 to 400 $m^2/g$ and produced by the precipitation method, and second amorphous silica pigment particles having a BET specific surface area of 250 to 1500 $m^2/g$, more preferably 250 to 500 $m^2/g$ and preferably a pore volume of 1.5 ml/g or less, and produced by the gelation method.

Among the amorphous silica pigments, the second amorphous silica pigment particles produced by the gelation method, and having a BET specific surface area of 250 to 1500 $m^2/g$ and preferably a pore volume of 1.5 ml/g or less per se, have a certain ink-absorbing property, contribute to the reproducibility of the images, form a strong ink receiving layer and enhance the pencil writing property. The pore volume is more preferably 0.7 to 1.4 ml/g. If the pore volume is more than 1.5 ml/g, the primary particles have a large size, and form relatively loose secondary particles, and therefore, a satisfactory effect on improvement of the pencil writing property may not be obtained. However, the amorphous silica pigment particles produced by the above-mentioned gelation method have the primary particles strongly agglomerated with each other. Therefore, when this type of pigment particle is used in too large an amount, the resultant ink receiving layer may exhibit a reduced ink receiving property. Therefore, when this type of pigment particle is used alone, the object of this embodiment cannot be attained.

On the other hand, the amorphous silica pigment particles produced by the precipitation method are provided with a large number of fine pores in which the ink can be caught, have an excellent ink receiving property and a good reproducibility of the images.

However, in this type of pigment particle, the bonding power of the primary particles to each other is relatively weak, and thus a problem such that the ink receiving layer is exfoliated and pencil writing is difficult, may occur. Therefore, when this type of amorphous silica pigment particle is used alone, it is difficult to obtain a satisfactory result.

With respect to the pore volume of the amorphous silica pigments, the volume of pores having a pore radius of 7.5 nm or less is measured by a BET surface area-measurement apparatus P-600 (made by Shibata Kagakukikai K. K.), and the volume of the pores having a pore radius of 7.5 to 7500 nm is measured by a POROSIMETER MOD. AG/65 (made by CARLO. ERBA), and the measured volumes are totalized.

Namely, in this embodiment, the pencil writing property of the ink receiving layer is enhanced without degrading the reproducibility of high accuracy, high resolution images, by co-using two or more types of agglomerate pigment particles having strong surfaces and pores appropriate to absorb the ink. This enhancement can be attained by controlling the BET specific surface area of the agglomerate (secondary) particles produced by the precipitation method and the gelatinization method, and the pore volume of the agglomerate (secondary) particles produced by the gelation method.

To provide an ink jet recording medium having an excellent reproducibility of high accuracy images and a superior aptitude for office recording sheet, the amorphous silica pigment produced by the gelation method is preferably contained in a content of 10 to 70% by weight based on the total weight of the amorphous silica pigments.

In the amorphous silica pigment-containing ink receiving layer, if the content of the amorphous silica pigment produced by the gelation method, and having a BET specific surface area of 250 to 1500 $m^2/g$ and preferably a pore volume of 1.5 ml/g or less is too small, the resultant ink receiving layer may be easily damaged by pencil and thus may exhibit a poor pencil-writing property, while the resultant ink receiving layer may exhibit a satisfactory aptitude for ink jet recording. If the content of the amorphous silica pigment particles produced by the gelation method, and having a BET specific surface area of 250 to 1500 $m^2/g$ and preferably a pore volume of 1.5 ml/g or less is too large, the resultant ink receiving layer may exhibit an unsatisfactory aptitude for ink jet recording, while the pencil writing property of the ink receiving layer may be satisfactory.

Further, the surface of the ink receiving layer of the ink jet recording medium of the present invention preferably has a 180 degree peel strength of 0.15 kN/m or more, more preferably 0.2 kN/m or more, determined in accordance with Japanese Industrial Standard (JIS) K 6854. This feature contributes to maintaining the pencil writing property of the ink receiving layer at a high level. There is no specific upper limit to the 180 degree peel strength. Usually, a 180 degree peel strength up to about 0.4 kN/m could be obtained.

In the ink jet recording medium of the present invention, the substrate is not limited to that formed from a specific material. The substrate may be selected from paper sheets produced from a paper-forming pulp and optionally a filler, for example, talc, kaolin, calcined kaolin, and calcium carbonate by a conventional acidic or neutral paper-forming method. The materials other than the paper sheets for the substrate may be selected from nonwoven fabrics produced by a wet method or dry method, or plastic films, for example, polypropylene, polyethylene, polyvinyl chloride and polyethylene terephthalate films.

The aqueous ink usable for the ink jet recording medium of the present invention contains at least one dye selected from, for example, water-soluble direct dyes and water-soluble acid dyes, and optionally at least one additive selected from, for example, wetting agents, dye-dissolving agents, antiseptics and antifungal agents. The water-soluble direct dyes usable for the aqueous ink include C.I. Direct Blacks 17, 19 and 21, C.I. Direct Yellows 11 and 27, C.I. Direct Blues 15, 6 and 202, and C.I. Direct Reds 33, 46 and 81. Also, the water-soluble acid dyes include C.I. Acid Blacks 7, 26 and 119, C.I. Acid Yellows 42 and 38, C.I. Acid Blues 103, 93 and 142, and C.I. Acid Reds 94, 89 and 106. However, the direct and acid dyes are not limited to the above-mentioned dyes.

EXAMPLES

The present invention will be further explained in detail by the following examples which are not intended to limit the scope of the present invention in any way.

In the examples, "part" and "%" mean "part by weight" and "% by weight" unless otherwise indicated.

Example Group I

In the example group I, the following tests were applied to determine physical properties of the products.

1) Color density of recorded images

A specimen of ink jet recording medium was subjected to an ink jet recording using an ink jet printer (model: MJ 700V2C, made by Seiko-Epson), at a recording density of 720 dpi, and the color density of the printed images were determined. The result of the test was evaluated by naked eye observation.

| Class | Color density |
|---|---|
| A | Excellent |
| B | Practically satisfactory |
| C | Bad |

2) Drying property of printed ink images

A specimen was subjected to a 100% density printing by using an ink jet printer (model: Desk Jet 560J, made of Hewllet-Packard), and the drying condition of the ink was observed by naked eye. The print drying property was evaluated by the drying time between the delivery of the specimen from the printer and the disappearance of gloss of the ink images, as follows.

| Class | Drying time |
|---|---|
| A | Gloss disappeared within several seconds from delivery. |

-continued

| Class | Drying time |
|---|---|
| B | Gloss disappeared after several tens of seconds. Practically usable. |
| C | Gloss is retained for 2 minutes or more. Problem may occur in practice. |

3) Pencil writing property

Hand writing was carried out with a HB pencil. The exfoliation of the ink receiving layer and the clarity of the pencil marks were observed and evaluated by naked eye, as follows.

| Class | Pencil writing property |
|---|---|
| A | Hand writing is very easy. Dark pencil mark is obtained. |
| B | Hand writing is practically useful. Pencil mark is slightly light. |
| C | Pencil mark is light, and practically usable. |
| D | Pencil mark is very light, and practically useless. |

4) Pencil mark-erasing property with rubber eraser

Pencil (HB) marks are formed by hand on a specimen, and erased by an eraser rubber. The erasing result is observed and evaluated by naked eye, as follows.

| Class | Erasing property |
|---|---|
| A | Pencil marks are very easily erased. |
| B | Pencil marks are erased without difficulty. |
| C | Pencil marks are erased with slight difficulty. Practically usable. |
| D | Pencil marks are difficult to erase. Practically useless. |

5) Pencil scratch value for coated film

A sapphire needle was attached to a pencil scratch tester for coated film in accordance with Japanese Industrial Standard K 5401, and a specimen was subjected to a pencil scratch test under a load of 30 g. The test was repeated while increasing the load by 10 g at a time. In every test, the end of the sapphire needle was observed by naked eye through a loupe at a magnification of 10. A largest load under which no powder derived from an exfoliated portion of the ink receiving layer is found on the end of the needle represents a pencil scratch value in gram.

Example I-1

An aqueous dispersion was prepared by mixing 20 parts of an amorphous silica pigment having an average particle size of 8 $\mu$m and a BET specific surface area of 420 $m^2/g$ (trademark: Carplex BS-304N, made by Shionogi Seiyaku K. K. gelation method), and 80 parts of an amorphous silica pigment having an average particle size of 5 $\mu$m and a BET specific surface area of 290 $m^2/g$ (trademark: Finesil X-45, made by K. K. Tokuyama, precipitation method) to 500 parts of a 1% aqueous solution of a polyamide resin (trademark: Polyfix 3000, made by Showa Kobunshi K. K.). To the aqueous dispersion, 250 parts of a 10% aqueous solution of a modified polyvinyl alcohol (trademark: Kuraray Poval R-1130, made by K. K. Kuraray), as a binder, to provide a coating liquid for an ink receiving layer. The coating liquid was coated on a surface of a wood free paper sheet having a basis weight of 70 $g/m^2$ and a Stochigt size degree of 7 seconds by using a Mayer bar and dried to form an ink receiving layer in a dry amount of 15 $g/m^2$. Then the resultant ink receiving layer was surface smoothed by a super calender treatment under a linear pressure of 50 kg/cm at a sheet-forwarding speed of 5 m/minute. An ink jet recording medium was obtained.

Test results are shown in Table 1.

Example I-2

An ink jet recording medium was produced by the same procedures as in Example I-1, except that the super calender treatment was omitted.

The test results are shown in Table 1.

Comparative Example I-1

An ink jet recording medium was produced by the same procedures as in Example I-2, except that the 10% aqueous solution of the modified polyvinyl alcohol (trademark: Kuraray Poval R-1130, made by K. K. Kuraray) was used in an amount of 180 parts.

The test results are shown in Table 1.

Example I-3

An ink jet recording medium was produced by the same procedures as in Example I-1, except that the amorphous silica pigment having an average particle size of 5 $\mu$m and a BET specific surface area of 290 $m^2/g$ (trademark: Finesil X-45, made by K. K. Tokuyama, precipitation method) was employed in an amount of 100 parts.

The test results are shown in Table 1.

Comparative Example I-2

An ink jet recording medium was produced by the same procedures as in Example I-3, except that the 10% aqueous solution of the modified polyvinyl alcohol (trademark: Kuraray Poval R-1130, made by K. K. Kuraray) was used in an amount of 180 parts.

The test results are shown in Table 1.

Example I-4

An ink jet recording medium was produced by the same procedures as in Example I-1, except that the amorphous silica pigment having an average particle size of 8 $\mu$m and a BET specific surface area of 420 $m^2/g$ (trademark: Carplex BS-304N, made by Shionogi Seiyaku K. K. gelation method) was employed in an amount of 100 parts.

The test results are shown in Table 1.

Example I-5

An ink jet recording medium was produced by the same procedures as in Comparative Example I-1 except that the ink receiving layer was formed in an amount of 5 $g/m^2$.

The test results are shown in Table 1.

Example I-6

An ink jet recording medium was produced by the same procedures as in Example I-1, except that the amorphous silica pigment having an average particle size of 8 $\mu$m and a BET specific surface area of 420 $m^2/g$ (trademark: Carplex BS-304N, made by Shionogi Seiyaku K. K. gelation method) was employed in an amount of 60 parts, and the amorphous silica pigment having an average particle size of 5 μm and a BET specific surface area of 290 $m^2/g$ (trademark: Finesil X-45, made by K. K. Tokuyama) was employed in an amount of 40 parts.

The test results are shown in Table 1.

Example I-7

An ink jet recording medium was produced by the same procedures as in Example I-6, except that the super calender treatment was carried out under a linear pressure of 20 kg/cm at a sheet-forwarding speed of 5 m/minute.

The test results are shown in Table 1.

Example I-8

An ink jet recording medium was produced by the same procedures as in Example I-7, except that an amorphous silica pigment having an average particle size of 12 μm and a BET specific surface area of 300 $m^2/g$ (trademark: Sailicia #470, made by Fuji Shilicia K. K. gelation method) was employed in an amount of 50 parts, and another amorphous silica pigment having an average particle size of 1.5 μm and a BET specific surface area of 300 $m^2/g$ (trademark: Sailicia #310, made by Shilicia K. K. gelation method) was employed in an amount of 50 parts.

The test results are shown in Table 1.

Example I-9

An ink jet recording medium was produced by the same procedures as in Example I-7, except that the amorphous silica pigment having an average particle size of 8 μm and a BET specific surface area of 420 $m^2/g$ (trademark: Carplex BS-304N, made by Shionogi Seiyaku K. K. gelation method) was employed in an amount of 5 parts, and another amorphous silica pigment having an average particle size of 12 μm and a BET specific surface area of 300 $m^2/g$ (trademark: Sailicia #470, made by Fuji shilicia K. K. gelation method) was employed in an amount of 50 parts.

The test results are shown in Table 1.

Example I-10

An ink jet recording medium was produced by the same procedures as in Example I-5, except that the amorphous silica pigment having an average particle size of 8 μm and a BET specific surface area of 420 $m^2/g$ (trademark: Carplex BS-304N, made by Shionogi Seiyaku K. K. gelation method) was employed in an amount of 70 parts, and the amorphous silica pigment having an average particle size of 5 μm and a BET specific surface area of 290 $m^2/g$ (trademark: Finesil X-45, made by K. K. Tokuyama, precipitation method) was employed in an amount of 30 parts.

The test results are shown in Table 1.

With respect to the 12 types of the above-mentioned ink jet recording media, the properties thereof were evaluated. The results are shown in Table 1. In Table 1, the column "S/P" indicates whether the super calender treatment was applied and when applied, a linear pressure, and the column "C/W" indicates the dry coating amount of the ink receiving layer.

TABLE 1

| | | Item | | | | | | | | | |
|---|---|---|---|---|---|---|---|---|---|---|---|
| | | Pigment | | | | | | | | | Pencil |
| Example No. | | BET specific surface area ($m^2/g$) | Particle size (μm) | Amount (part) | S/P kg/cm | C/W $g/m^2$ | Color density | Drying property | Pencil writing property | Pencil mark erasing property | scratch value (g) |
| Example | I-1 | 420(*)$_1$ | 8 | 20 | 50 | 15 | A | B | A | B | 80 |
| | | 290(*)$_2$ | 5 | 80 | | | | | | | |
| | I-2 | 420(*)$_1$ | 8 | 20 | 0 | 15 | A | A | B | C | 60 |
| | | 290(*)$_2$ | 5 | 80 | | | | | | | |
| Comparative Example | I-1 | 420(*)$_1$ | 8 | 20 | 0 | 15 | A | A | D | D | 40 |
| | | 290(*)$_2$ | 5 | 80 | | | | | | | |
| Example | I-3 | 290(*)$_2$ | 5 | 100 | 50 | 15 | A | A | C | C | 60 |
| Comparative Example | I-2 | 290(*)$_2$ | 5 | 100 | 50 | 15 | A | A | D | D | 40 |
| Example | I-4 | 420(*)$_1$ | 8 | 100 | 50 | 15 | B | B | A | A | 190 |
| | I-5 | 420(*)$_1$ | 8 | 20 | 0 | 5 | A | B | A | B | 90 |
| | | 290(*)$_2$ | 5 | 80 | | | | | | | |
| | I-6 | 420(*)$_1$ | 8 | 60 | 50 | 15 | A | A | A | A | 220 |
| | | 290(*)$_2$ | 5 | 40 | | | | | | | |
| | I-7 | 420(*)$_1$ | 8 | 60 | 20 | 15 | A | A | A | A | 200 |
| | | 290(*)$_2$ | 5 | 40 | | | | | | | |
| | I-8 | 300(*)$_1$ | 12 | 50 | 20 | 15 | B | A | A | B | 80 |
| | | 300(*)$_1$ | 1.5 | 50 | | | | | | | |
| | I-9 | 420(*)$_1$ | 8 | 50 | 20 | 15 | B | B | A | A | 240 |
| | | 300(*)$_1$ | 12 | 50 | | | | | | | |
| | I-10 | 420(*)$_1$ | 8 | 70 | 0 | 5 | B | B | A | A | 120 |
| | | 290(*)$_2$ | 5 | 30 | | | | | | | |

Note:
(*)$_1$ . . . Produced by a gelation method
(*)$_2$ . . . Produced by a precipitation method Table 1 clearly shows that the ink jet recording media of the examples in accordance with the present invention exhibited higher reproducibility of images, color density of printed images, drying property of ink, pencil writing property and pencil mark-erasing property with an eraser rubber, than those in the comparative examples.

Example Group II

In the example group II, the following tests were applied to the resultant products.

1) Reproducibility of images

A specimen of ink jet recording medium was subjected to a color density-gradation printing at a recording density of 720 dpi by using an ink jet printer (model: MJ 700V2C, made by Seiko-Epson).

The reproducibility of images is evaluated in accordance with linearity of the relationship between the printed area percentage and the color density of printed images, as follows.

| Class | Image reproducibility |
|---|---|
| A | Printed area percentage-image color density linearity is good. |
| B | Printed area percentage-image color density linearity is bad. |

2) Drying property of printed ink images

A specimen was subjected to a solid printing by using an ink jet printer (model: Desk Jet 560J, made by Hewllet-Packard), and the dried portion was evaluated by naked eye. In the evaluation, the drying property was classified in accordance with the necessary time to drying, as follows.

| Class | Drying property |
|---|---|
| A | Drying property is excellent. |
| B | Drying property is satisfactory. |
| C | Drying Property is bad. |

3) Pencil writing property

When hand writing was carried out with a H pencil, the exfoliation of the ink receiving layer and the clarity of the pencil marks were observed. The pencil writing property was evaluated in accordance with the observation results, as follows.

| Class | Pencil writing |
|---|---|
| A | No exfoliation of ink receiving layer occurs, and pencil marks are clear. |
| B | Slight exfoliation of ink receiving. layer occurs, and pencil marks are slightly unclear. |
| C | Ink receiving layer is exfoliated and the pencil marks are unclear. |

4) Pencil scratch value

This is measured in the manner as mentioned in the example group I.

Example II-1

A coating liquid for an ink receiving layer was prepared by dispersing 50 parts of an amorphous silica pigment (1) (trademark: Carplex #67, made by Shionogi Seiyaku K. K.) produced by a gelation method, containing 20% of particles with a particle size of 10 $\mu$m or more, having a median particle size (middle accumulated value, which will be referred to as an average particle size hereinafter) of about 5 $\mu$m, a primary particle size of about 5.5 nm, a BET specific surface area of 430 $m^2/g$, and 35 parts of an amorphous silica pigment (2) (trademark: Finesil X-37, made by K. K. Tokuyama) produced by a precipitation method, having an average size of about 3 $\mu$m, a primary particle size of about 10 nm and a BET specific surface area of 240 to 280 $m^2/g$, in 500 parts of a 1% aqueous solution of a polyamide resin (trademark: Polyfix 3000, made by Showa Kobunshi K. K.), and adding, into the resultant aqueous dispersing, 150 parts of a binder consisting of a 10% aqueous solution of polyvinyl alcohol (trademark: Kuraray Poval PVA-117, made by K. K. Kuraray).

The coating liquid for the ink receiving layer contained secondary particles, having a particle size of 10 $\mu$m or more, of Carplex #64 having a BET specific surface area of 430 $m^2/g$, in a content of about 10% based on the total solid content thereof. The coating liquid was coated on a surface of a wood-free paper sheet having a basis weight of 70 $g/m^2$ and a Stochigt size degree of 5 seconds by using a Mayer bar and dried to form an ink receiving layer in a dry amount of 10 $g/m^2$. The resultant ink receiving layer was surface-smoothed by a super calender treatment. An ink jet recording medium was obtained.

Example II-2

An ink jet recording medium was produced by the same procedures as in Example II-1, except that an aqueous dispersion in which 45 parts of an amorphous silica pigment (1) (trademark: Carplex BS-304N, made by Shionogi Seiyaku K. K.) made by a gelation method, containing 50% of particles with a particle size of 10 $\mu$m or more, and having an average particle size of about 10 $\mu$m, a primary particle size of about 5.5 nm and a BET specific surface area of 420 $m^2/g$ and 40 parts of the amorphous silica pigment (2) (trademark: Finesil X-37, made by K. K. Tokuyama) produced by a precipitation method, and having an average particle size of about 3 $\mu$m, a primary particle size of about 10 nm and a BET specific surface area of 240 to 280 $m^2/g$ were dispersed in 500 parts of a 1% aqueous solution of a polyamide resin (trademark: Polyfix 3000, made by Showa Kobunshi K. K.), was employed.

The test results are shown in Table 2.

Example II-3

An ink jet recording medium was produced by the same procedures as in Example II-1, except that an aqueous dispersion in which 60 parts of an amorphous silica pigment (1) (trademark: Mizukasorb C-1, made by Mizusawa Kagaku K. K.) produced by a gelation method, containing 30% of particles with a particle size of 10 $\mu$m or more, and having an average particle size of about 7 $\mu$m, a primary particle size of about 5.0 nm and a BET specific surface area of 410 $m^2/g$ and 25 parts of the amorphous silica pigment (2) (trademark: Finesil X-37, made by K. K. Tokuyama) produced by a precipitation method, and having an average particle size of about 3 $\mu$m, a primary particle size of about 10 nm and a BET specific surface area of 240 to 280 $m^2/g$ were dispersed in 500 parts of a 1% aqueous solution of a polyamide resin (trademark: Polyfix 3000, made by Showa Kobunshi K. K.), was employed.

The test results are shown in Table 2.

Example II-4

An ink jet recording medium was produced by the same procedures as in Example II-1, except that an aqueous dispersion in which 25 parts of an amorphous silica pigment (1) (trademark: Sailicia #470, made by Fuji Shilicia Kagaku K. K.) produced by a gelation method, containing 80% of particles with a particle size of 10 μm or more, and having an average particle size of about 20 μm, a primary particle size of about 8.0 nm and a BET specific surface area of 300 $m^2/g$ and 55 parts of the amorphous silica pigment (2) (trademark: Finesil X-37, made by K. K. Tokuyama) produced by a precipitation method, and having an average particle size of about 3 μm, a primary particle size of about 10 nm and a BET specific surface area of 240 to 280 $m^2/g$ were dispersed in 500 parts of a 1% aqueous solution of a polyamide resin (trademark: Polyfix 3000, made by Showa Kobunshi K. K.), was employed.

The test results are shown in Table 2.

TABLE 2

| | Item | | | | | | | |
|---|---|---|---|---|---|---|---|---|
| | BET-specific surface area ($m^2/g$) | | Content$(*)_1$ of particles with ≧10 μm | Primary particle size$(*)_2$ | | Ink | Pencil | Pencil |
| Example No. | Pigment (1) | Pigment (2) | and >350 $m^2/g$ (wt %) | >350 $m^2/g$ (nm) | Image reproducibility | drying property | writing property | scratch value |
| II-1 | 430$(*)_3$ | 260$(*)_4$ | 10 | 5.5 | A | A | A | 150 |
| II-2 | 420$(*)_3$ | 260$(*)_4$ | 18 | 5.5 | A | A | A | 200 |
| II-3 | 410$(*)_3$ | 260$(*)_4$ | 23 | 5.0 | A | A | A | 200 |
| II-4 | 300$(*)_3$ | 260$(*)_4$ | 0 | — | A | A | B | 60 |

Note:
$(*)_1$ . . . Content of secondary particles having a particle size of 10 μm or more and a BET specific surface area of more than 350 $m^2/g$, based on total weight of ink receiving layer.
$(*)_2$ . . . Particle size of primary particles in secondary particles with a BET specific surface area of more than 350 $m^2/g$.
$(*)_3$ . . . Produced by a gelation method.
$(*)_4$ . . . Produced by a precipitation method.

Example Group III

In the example group III, the following tests were applied to the products.

1) Reproducibility of images

A specimen of an ink jet recording medium was subjected to a color density-gradation printing at a recording density of 720 dpi by using an ink jet printer (model: MJ 700V2C, made by Seiko-Epson).

The reproducibility of images is evaluated in accordance with linearity of the relationship between the printed area percentage and the color density.

| Class | Drying property |
|---|---|
| A | Good |
| B | slightly bad |
| C | Practically unusable |

2) Drying property of printed ink images

A specimen was subjected to a solid printing by using an ink jet printer (model: Desk Jet 560J, made by Hewllet-Packard), and the dried portion was evaluated by naked eye. In the evaluation, the drying property was classified in accordance with the necessary time to drying, as follows.

| Class | Drying time |
|---|---|
| A | Less than 2 seconds, good |
| B | 2 to 10 seconds, practically disable |
| C | More than 10 seconds, practically useless |

3) Surface strength

The surface strength of ink receiving layer was represented by a peel strength of the ink receiving layer adhered to a adhesive tape (trademark: Scotch Clear Tape CH-24, made by Sumitomo 3M K. K.) at a peeling angle of 180 degree. This peel strength was determined by using a constant speed tensile tester equipped with an automatic recorder in accordance with Japanese Industrial Standard K 6854-1994.

The tester had a crosshead movable at a constant travelling speed and a fixed gripper.

Referring to FIG. 1, a specimen (1) of an ink jet recording medium was fixed at a back surface thereof to a plastic plate 2 fixed to the crosshead (not shown in the drawing) through a double adhesive-coated tape 3, while preventing formation of air bubbles in the interface between the tape 3 and the specimen 1 and the plate 2. The specimen 1 had a width of 25 mm and a length of 160 mm. The plastic plate 2 had a width of 25 mm and a length of 180 mm. The double adhesive-coated tape 3 had the same width as the plastic plate 2.

An adhesive tape (Scotch Clear Tape CH-24) 4 having the same width as the specimen 1 was fixed to the ink receiving layer surface of the specimen 1, and an end portion of the adhesive tape 4 was folded outward and fixed to a plastic plate 5, as shown in FIG. 1.

The plastic plate 5 was roll-pressed against the adhesive tape 4 and the specimen 1 by rolling a roll (not shown in the drawing) having a weight of 5 kg per 25 mm width in two round trips under a linear pressure of 2 kg/cm.

The plastic plate 5 was fixed to the fixed gripper (not shown in the drawing), and the plastic plate 2 fixed to the crosshead (not shown in the drawing) was moved in parallel to the surface of thereof and the peel strength at 180 degree between the ink receiving layer of the specimen 1 and the adhesive tape 4 was recorded.

4) Pencil writing property

When hand writing was carried out with a H pencil, the exfoliation of the ink receiving layer and the clarity of the pencil marks were observed. The pencil writing property was evaluated in accordance with the observation results, as follows.

| Class | Pencil writing |
|---|---|
| A | Good |
| B | slightly bad |
| C | Practically unusable |

Example III-1

A coating liquid for an ink receiving layer was prepared by mixing 60 parts of an amorphous silica pigment (1) produced by a precipitation method and having a BET specific surface area of 290 $m^2/g$ (trademark: Finesil X-45, made by K. K. Tokuyama) and 40 parts by an amorphous silica pigment (2) prepared by a gelation method and having a BET specific surface area of 300 $m^2/g$ and a pore volume of 1.25 ml/g (trademark: Sailicia #450, made by Fuji Shilicia with 350 parts of a 10% aqueous solution of a silanol-modified polyvinyl alcohol (trademark: R-1130, made by K. K. Kuraray) and 7 parts of a cationic polydiallyldimethylammonium chloride resin (trademark: PAS-H-5L, made by Nitto Boseki K. K.); and diluting the resultant aqueous dispersion with water to adjust the solid content of the resultant mixture to 18%.

The coating liquid was coated on a surface of a wood-free paper sheet having a basis weight of 70 $g/m^2$ and a Stochigt size degree of 5 seconds by using a Mayer bar and then dried to form an ink receiving layer in a dry weight of 9 $g/m^2$. The resultant ink receiving layer was surface-smoothed by a super calender treatment. An ink jet recording medium was obtained.

The test results are shown in Table 3.

Example III-2

An ink jet recording medium was produced by the same procedures as in Example III-1, except that in the preparation of the coating liquid for the ink receiving layer, 50 parts of an amorphous silica pigment (1) produced by a precipitation method and having a BET specific surface area of 290 $m^2/g$ (trademark: Finesil X-45, made by K. K. Tokuyama) and 50 parts by weight of an amorphous silica pigment (2) produced by a gelation method and having a BET specific surface area of 400 $m^2/g$ and a pore volume of 1.08 ml/g (trademark: Carplex BS 304N, made by Shionogi Seiyaku K. K.) were used as a pigment component.

The test results are shown in Table 3.

Example III-3

An ink jet recording medium was produced by the same procedures as in Example III-1, except that as a pigment component, 100 parts of the amorphous silica pigment (1) alone (trademark: Finesil X-45, made by K. K. Tokuyama) produced by the precipitation method and having the BET specific surface area of 290 $m^2/g$ was employed.

The test results are shown in Table 3.

TABLE 3

| Item Example No. | | Reproducibility of images | Drying property of ink | Surface strength (kN/m) | Pencil writing property | Pencil scratch value |
|---|---|---|---|---|---|---|
| Example | III-1 | A | A | 0.25 | A | 200 |
| | III-2 | A | A | 0.29 | A | 200 |
| | III-3 | A | A | 0.14 | A | 90 |

Table 3 shows that the ink jet recording medium of Examples III-1 and III-2 produced in accordance with an embodiment of the present invention exhibited satisfactory reproducibility of images, a good drying property of ink and an excellent pencil writing property and were useful in practice.

We claim:

1. An ink jet recording medium comprising a substrate and an ink receiving layer formed on the substrate and comprising porous xerogel pigment particles, wherein the surface of the ink receiving layer has a pencil scratch value of 50 g or more determined by a pencil scratch tester for coated film in accordance with Japanese Industrial Standard K 5401-1969.

2. The ink jet recording medium as claimed in claim 1, wherein the pencil scratch value is 70 g or more.

3. The ink jet recording medium as claimed in claim 1, wherein the porous xerogel pigment particles contained in the ink receiving layer have a specific surface area of 25 to 400 $m^2/g$ determined by the BET method.

4. The ink jet recording medium as claimed in claim 3, wherein the ink receiving layer comprises first porous xerogel pigment particles having a BET specific surface area of 25 to 400 $m^2/g$ and second porous xerogel pigment particles having a BET specific surface area in the range of from 250 to 1500 $m^2/g$ and larger than the above-mentioned BET specific surface area of the first porous xerogel pigment particles.

5. The ink jet recording medium as claimed in claim 4, wherein the first porous xerogel pigment particles have a BET specific surface area of 100 to 400 $m^2/g$ and the second porous xerogel pigment particles have a BET specific surface area in the range of from 250 to 500 $m^2/g$ which is larger than the above-mentioned BET specific surface area of the first porous xerogel pigment particles.

6. The ink jet recording medium as claimed in claim 4, wherein the first porous xerogel pigment particles have an agglomerate secondary particle structure in which primary particles are agglomerated to form secondary particles and have a BET specific surface area of 25 to 350 $m^2/g$; the second porous xerogel pigment particles have an agglomerate secondary particle structure in which primary particles are agglomerated to form secondary particles, and have a BET specific surface area of more than 350 $m^2/g$ but not more than 1500 $m^2/g$; and a fraction of the second porous xerogel pigment particles consisting of pigment particles having a secondary particle size of 10 $\mu m$ or more occupies 8 to 30% by weight of the ink receiving layer.

7. The ink jet recording medium as claimed in claim 4, wherein, in the ink receiving layer, the first porous xerogel pigment particles having the agglomerate secondary particle structure are amorphous silica particles produced by a precipitation method and having a BET specific surface area of 25 to 400 $m^2/g$; and the second porous xerogel pigment particles having the agglomerate secondary particle structure are amorphous silica particles produced by a gelation method and having a BET specific surface area of 250 to 1500 $m^2/g$.

8. The ink jet recording medium as claimed in claim 1 or 7, wherein the ink receiving layer has a 180 degree peel strength of 0.15 kN/m or more determined in accordance with Japanese Industrial Standard K 6854.

9. The ink jet recording medium as claimed in claim 4, wherein the second porous xerogel pigment particles having a BET specific surface area of 250 to 1500 $m^2/g$ have an average particle size larger than that of the first porous xerogel pigment particles having a BET specific surface area of 25 to 400 $m^2/g$.

10. The ink jet recording medium as claimed in claim 9, wherein the first porous xerogel pigment particles having a BET specific surface area of 25 to 400 $m^2/g$ have an average particle size of 1 to 15 $\mu$m, and the second porous xerogel pigment particles having a BET specific surface area of 250 to 1500 $m^2/g$ have an average particle size of 3 to 30 $\mu$m.

* * * * *